US008858868B2

(12) United States Patent
Kang et al.

(10) Patent No.: US 8,858,868 B2
(45) Date of Patent: Oct. 14, 2014

(54) TEMPERATURE REGULATED VESSEL

(75) Inventors: John Kang, Coto de Caza, CA (US); Quoc Tran Pham, Anaheim, CA (US); Theodore Andrew Waniuk, Lake Forest, CA (US); Sean Timothy O'Keeffe, Coto de Caza, CA (US); Joseph W. Stevick, Glendora, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 411 days.

(21) Appl. No.: 13/208,800

(22) Filed: Aug. 12, 2011

(65) Prior Publication Data

US 2013/0037999 A1 Feb. 14, 2013

(51) Int. Cl.

| | |
|---|---|
| ***B22D 27/04*** | (2006.01) |
| ***F27B 14/06*** | (2006.01) |
| ***B22D 17/20*** | (2006.01) |
| ***B22D 17/22*** | (2006.01) |
| ***F27B 14/20*** | (2006.01) |
| ***B22D 17/04*** | (2006.01) |
| ***B22D 17/14*** | (2006.01) |
| ***F27B 17/00*** | (2006.01) |
| ***F27D 9/00*** | (2006.01) |
| ***F27B 14/14*** | (2006.01) |

(52) U.S. Cl.

CPC ..... *F27B 14/061* (2013.01); *F27B 14/063* (2013.01); *B22D 17/2038* (2013.01); *B22D 17/2227* (2013.01); *F27B 14/20* (2013.01); *B22D 17/04* (2013.01); *B22D 17/14* (2013.01); *F27B 17/00* (2013.01); *F27D 9/00* (2013.01); *F27B 14/14* (2013.01)

USPC ..... 266/241; 266/275

(58) Field of Classification Search

USPC ..... 266/241, 235, 275

See application file for complete search history.

(56) References Cited

U.S. PATENT DOCUMENTS

| | | | |
|---|---|---|---|
| 3,671,029 | A | 6/1972 | Karlsson |
| 3,731,727 | A | 5/1973 | Mitamura et al. |

(Continued)

FOREIGN PATENT DOCUMENTS

| | | |
|---|---|---|
| DE | 19902002 | 7/2000 |
| EP | 0845316 | 6/1998 |

(Continued)

OTHER PUBLICATIONS

Inoue et al., "Bulk amorphous alloys with high mechanical strength and good soft magnetic properties in Fe—Tm—B(Tm=IV-VIII group transition metal) system", Appl. Phys. Lett., vol. 710, p. 464 (1997).

(Continued)

*Primary Examiner* — Scott Kastler

(74) *Attorney, Agent, or Firm* — Pillsbury Winthrop Shaw Pittman LLP

(57) ABSTRACT

Disclosed is a temperature regulated vessel, and method for using the same, having a body configured to melt meltable material received therein, and one or more temperature regulating lines within the body configured to flow a liquid therein for regulating a temperature of the meltable material received in the melting portion. The vessel has a poor or low thermally conductive material on one or more of its parts, such as on the melting portion, on exterior surfaces of the body, and/or surrounding the temperature regulating lines to increase melt temperature of the material. The melting portion can also have indentations in its surface, and low thermally conductive material can be provided in the indentations. The vessel can be used to melt amorphous alloys, for example.

64 Claims, 8 Drawing Sheets

(56) References Cited

U.S. PATENT DOCUMENTS

| | | | | |
|---|---|---|---|---|
| 4,040,845 | A | 8/1977 | Richerson et al. | |
| 4,135,568 | A | 1/1979 | Brooks | |
| 4,265,294 | A | 5/1981 | Gaule | |
| 4,550,412 | A | 10/1985 | Holcombe et al. | |
| 4,612,973 | A | 9/1986 | Whang | |
| 4,678,024 | A | 7/1987 | Hull | |
| 4,693,299 | A | 9/1987 | Kuznetsov et al. | |
| 4,799,532 | A | 1/1989 | Mizuhara | |
| 4,887,798 | A | 12/1989 | Julius | |
| 5,003,551 | A | 3/1991 | Mortimer | |
| 5,087,804 | A | 2/1992 | McGaffigne | |
| 5,288,344 | A | 2/1994 | Peker et al. | |
| 5,291,940 | A * | 3/1994 | Borofka et al. | 164/494 |
| 5,368,659 | A | 11/1994 | Peker et al. | |
| 5,487,421 | A | 1/1996 | Gerber | |
| 5,616,024 | A | 4/1997 | Nobori | |
| 5,618,359 | A | 4/1997 | Lin et al. | |
| 5,711,363 | A | 1/1998 | Scruggs et al. | |
| 5,735,975 | A | 4/1998 | Lin et al. | |
| 5,896,642 | A | 4/1999 | Peker | |
| 5,976,247 | A | 11/1999 | Hansen et al. | |
| 6,021,840 | A | 2/2000 | Colvin | |
| 6,189,600 | B1 | 2/2001 | Taniguchi et al. | |
| 6,267,170 | B1 | 7/2001 | Onuki | |
| 6,267,171 | B1 | 7/2001 | Onuki | |
| 6,283,197 | B1 | 9/2001 | Kono | |
| 6,325,868 | B1 | 12/2001 | Kim et al. | |
| 6,371,195 | B1 | 4/2002 | Onuki | |
| 6,427,753 | B1 | 8/2002 | Inoue | |
| 6,561,259 | B2 * | 5/2003 | Spadafora et al. | 164/488 |
| 6,875,293 | B2 | 4/2005 | Peker | |
| 7,017,645 | B2 | 3/2006 | Johnson et al. | |
| 7,235,910 | B2 | 6/2007 | Decristofaro et al. | |
| 7,377,303 | B2 | 5/2008 | Go | |
| 7,488,170 | B2 | 2/2009 | Yuasa et al. | |
| 7,575,040 | B2 | 8/2009 | Johnson | |
| 7,708,844 | B2 | 5/2010 | Muramatsu | |
| 7,906,219 | B2 | 3/2011 | Ohara et al. | |
| 2002/0005233 | A1 | 1/2002 | Schirra et al. | |
| 2005/0028961 | A1 | 2/2005 | Toyoshima et al. | |
| 2005/0242454 | A1 | 11/2005 | Yuasa et al. | |
| 2006/0042773 | A1 | 3/2006 | Eisen | |
| 2006/0254747 | A1 | 11/2006 | Ishida et al. | |
| 2007/0079907 | A1 | 4/2007 | Johnson et al. | |
| 2008/0118387 | A1 | 5/2008 | Demetriou et al. | |
| 2009/0236494 | A1 | 9/2009 | Hata et al. | |
| 2009/0321037 | A1 | 12/2009 | Lewis et al. | |
| 2010/0084052 | A1 | 4/2010 | Farmer et al. | |
| 2010/0098967 | A1 | 4/2010 | Schroers | |
| 2010/0300148 | A1 | 12/2010 | Demetriou et al. | |
| 2011/0011750 | A1 | 1/2011 | Lovens | |
| 2011/0108231 | A1 | 5/2011 | Zheng et al. | |

FOREIGN PATENT DOCUMENTS

| | | |
|---|---|---|
| EP | 1013363 | 6/2000 |
| EP | 1415740 | 5/2004 |
| FR | 2665654 | 2/1992 |
| GB | 392764 | 5/1933 |
| GB | 574914 | 1/1946 |
| GB | 784363 | 10/1957 |
| JP | 55036033 | 3/1980 |
| JP | 1994212205 | 7/1994 |
| JP | 6212205 | 8/1994 |
| JP | 8013111 | 1/1996 |
| JP | 9272929 | 10/1997 |
| JP | 1997272929 | 4/1999 |
| JP | 2000024767 | 1/2000 |
| JP | 2000326065 | 11/2000 |
| JP | 2001071113 | 3/2001 |
| JP | 2001259821 | 9/2001 |
| JP | 2001303218 | 10/2001 |
| JP | 2004050269 | 2/2004 |
| JP | 2006289466 | 10/2006 |
| JP | 2009068101 | 4/2009 |
| JP | 2009172627 | 8/2009 |
| JP | 2009173964 | 8/2009 |
| JP | 2010036210 | 2/2010 |
| WO | WO0037201 | 6/2000 |
| WO | 02/40727 A2 | 5/2002 |
| WO | WO2005004559 | 1/2005 |
| WO | WO2006127792 | 11/2006 |
| WO | WO2008046219 | 4/2008 |
| WO | WO2009067512 | 5/2009 |
| WO | WO2010108744 | 9/2010 |
| WO | WO2010111701 | 9/2010 |

OTHER PUBLICATIONS

Shen et al., 01., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

International Search Report issued in PCT/US2011/052354, mailed Mar. 16, 2012.

International Search Report issued in PCT/US2011/054153, mailed Jun. 13, 2012.

Wolf, S.; R.N. Tauber (1986),Silicon Processing for the VLSI Era: vol. 1—Process Technology. Lattice Press. pp. 531-534, 546.

Walker, Perrin; William H. Tarn (1991), CRC Handbook of Metal Etchants. pp. 287-291.

Kohler, Michael (1999). Etching in Microsystem Technology. John Wiley & Son Ltd. p. 329.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal", Aug. 1988.

Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994), pp. 808-813.

* cited by examiner

TEMPERATURE REGULATED VESSEL

BACKGROUND

1. Field

The present disclosure is generally related to vessels used for melting materials. More specifically, the present disclosure is related to controlling temperature of and cooling speed of vessels.

2. Description of Related Art

Cold hearth melting systems may be used to melt a metal or an alloy. The container can be designed to include a cooling system to force-cool the container and absorb heat during the heating/melting process. Examples of cooling and melting techniques for melting materials include skull melting (also known as cold wall induction melting), plasma hearth melting/plasma arc melting, and electron beam melting. All of these techniques may be used to process reactive metals such as titanium, zirconium, hafnium, and beryllium and alloys thereof, for example.

When melting such materials, water (or other suitable cooling liquid or fluid) may be used to absorb heat loss from the molten material and in the container base itself. Because the base is forced cooled, heat loss from the molten material and base to the water can be excessive, resulting in a waste of induction power and/or electricity.

SUMMARY

One aspect of the disclosure provides a temperature regulated vessel having a body with a melting portion configured to receive meltable material to be melted therein; one or more temperature regulating lines configured to flow a liquid therein for regulating a temperature of the body during melting of the meltable material received in the melting portion, and a first material of low thermal conductivity provided on at least the melting portion.

Another aspect of the disclosure provides a temperature regulated vessel having a body with a melting portion configured to receive meltable material to be melted therein; one or more temperature regulating lines configured to flow a liquid therein for regulating a temperature of the body during melting of the meltable material received in the melting portion, and a first material of low thermal conductivity provided on at least external surfaces of the body.

Another aspect of the disclosure provides a temperature regulated vessel having a body with a melting portion configured to receive meltable material to be melted therein; one or more temperature regulating lines configured to flow a liquid therein for regulating a temperature of the body during melting of the meltable material received in the melting portion, and a first material of low thermal conductivity surrounding the one or more temperature regulating lines.

Another aspect of the disclosure provides a temperature regulated vessel having a body with a melting portion configured to receive meltable material to be melted therein, the melting portion including a surface having a plurality of indentations therein, and one or more temperature regulating lines configured to flow a liquid therein for regulating a temperature of the body during melting of the meltable material received in the melting portion.

Another aspect of the disclosure provides temperature regulated vessel having a body with a melting portion configured to receive meltable material to be melted therein. The body is formed from a first material, and the meltable material is a second material. The vessel also includes one or more temperature regulating lines configured to flow a liquid therein for regulating a temperature of the body during melting of the meltable material received in the melting portion. The melting portion includes a surface having a plurality of indentations therein. At least the plurality of indentations of the melting portion include a third material.

Another aspect of the disclosure provides a method for melting meltable material including: obtaining a temperature regulated vessel having a body having a melting portion configured to receive meltable material to be melted therein, one or more temperature regulating lines configured to flow a liquid therein for regulating a temperature of the body during melting of the meltable material received in the melting portion, and a material of low thermal conductivity provided on at least part of the vessel; providing the meltable material on the melting portion; melting the meltable material using a heat source provided adjacent to the temperature regulated vessel, and flowing the liquid in the one or more temperature regulating lines.

Yet another aspect of the disclosure provides a method for melting meltable material including: obtaining a temperature regulated vessel having a body having a melting portion configured to receive meltable material to be melted therein, the melting portion comprising a surface having a plurality of indentations, and one or more temperature regulating lines configured to flow a liquid therein for regulating a temperature of the body during melting of the meltable material received in the melting portion; providing the meltable material on the melting portion; melting the meltable material using a heat source provided adjacent to the temperature regulated vessel, and flowing the liquid in the one or more temperature regulating lines.

Other features and advantages of the present disclosure will become apparent from the following detailed description, the accompanying drawings, and the appended claims.

DETAILED DESCRIPTION

The methods, techniques, and devices illustrated herein are not intended to be limited to the illustrated embodiments.

As previously noted, cold hearth systems that are used to melt materials, such as metals or alloys, may implement forced cooling techniques to absorb heat from the power/heat source (e.g., induction coil), base, and molten material. Cold hearth melting systems may consist of a container having liquid- or fluid-cooled base (also referred to as a vessel, plate, boat, or crucible) made from a highly conductive metal (such as copper), upon or in which a metal or an alloy is heated by the heat source until molten. By absorbing heat loss from the material and base, and thus maintaining the base at a low temperature, the resulting molten material is prevented from wetting and becoming contaminated by the container. However, the base and material should be controlled such that the heat loss/transfer to the cooling liquid does not result in a waste of induction power and/or electricity (and perhaps even affect melting of the metal or alloy). This disclosure describes exemplary embodiments of a temperature regulated vessel designed to force cool a base of a vessel used to melt metals or alloys during a heating/melting process without excessive power consumption, among other things.

Figure 1:
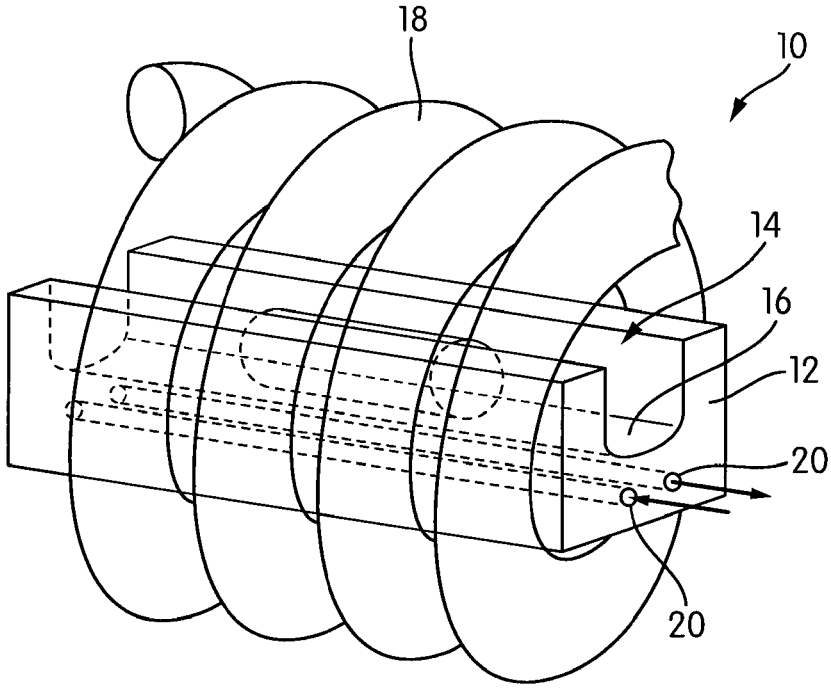
FIG. 1 illustrates a schematic plan view of a vessel with a surrounding induction coil in accordance with an embodiment.

For example, FIG. 1 illustrates an exemplary schematic view of a temperature regulated vessel 10 comprising a body 12 (or base) for meltable material to be melted therein. A vessel as used throughout this disclosure is a container made of a material employed for heating substances to high temperatures. For example, in an embodiment, the vessel may be a crucible, such as a boat style crucible or a skull crucible. In an embodiment, the vessel 10 is a cold hearth melting device that is configured to be utilized for meltable material(s) while under a vacuum (applied by a vacuum device, not shown in the Figures).

In an embodiment, the body 12 of the vessel 10 comprises a substantially U-shaped structure. For example, the body may comprise a base with side walls extending vertically therefrom. In an embodiment, the body 12 may comprise substantially rounded and/or smooth surfaces. For example, the surface 16 of the melting portion 14 may be formed in an arc shape (schematically shown in FIG. 10, for example). However, the shape and/or surfaces of the body 12 are not meant to be limiting. The body 12 may be an integral structure, or formed from separate parts that are joined or machined together.

Figure 8:
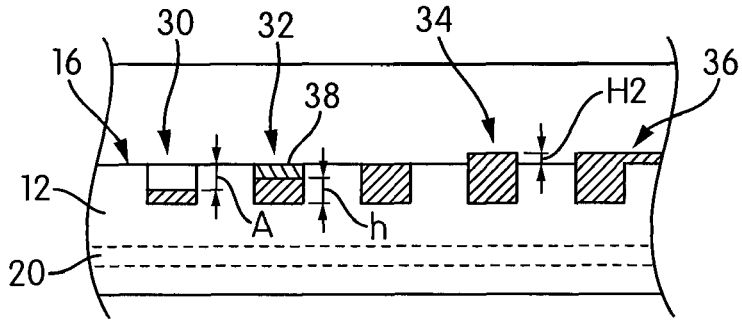
FIG. 8 illustrates a detailed view of indentations in the surface of the vessel with material therein in accordance with multiple embodiments.

The material for heating or melting may be received in a melting portion 14 of the vessel (e.g., via a loading port, as shown in FIG. 8). Melting portion 14 is configured to receive meltable material to be melted therein. For example, melting portion 14 has a surface 16 for receiving material. At least the melting portion 14 of the vessel, if not substantially the entire body 12 itself, is configured to be heated such that the material received therein is melted. Heating is accomplished using, for example, an induction coil 18 positioned adjacent the body 12. For example, as shown in FIG. 1, the induction coil 18 may be positioned in a helical pattern substantially around a length of the body 12. Accordingly, vessel 10 is configured to inductively melt a material, such as a metal or alloy, within the melting portion 14 by supplying power to induction coil 18. The induction coil 18 is configured to heat up and melt any material that is contained by the crucible without melting and wetting the crucible. The induction coil 18 emits radiofrequency (RF) waves towards the vessel 10.

Figure 9:
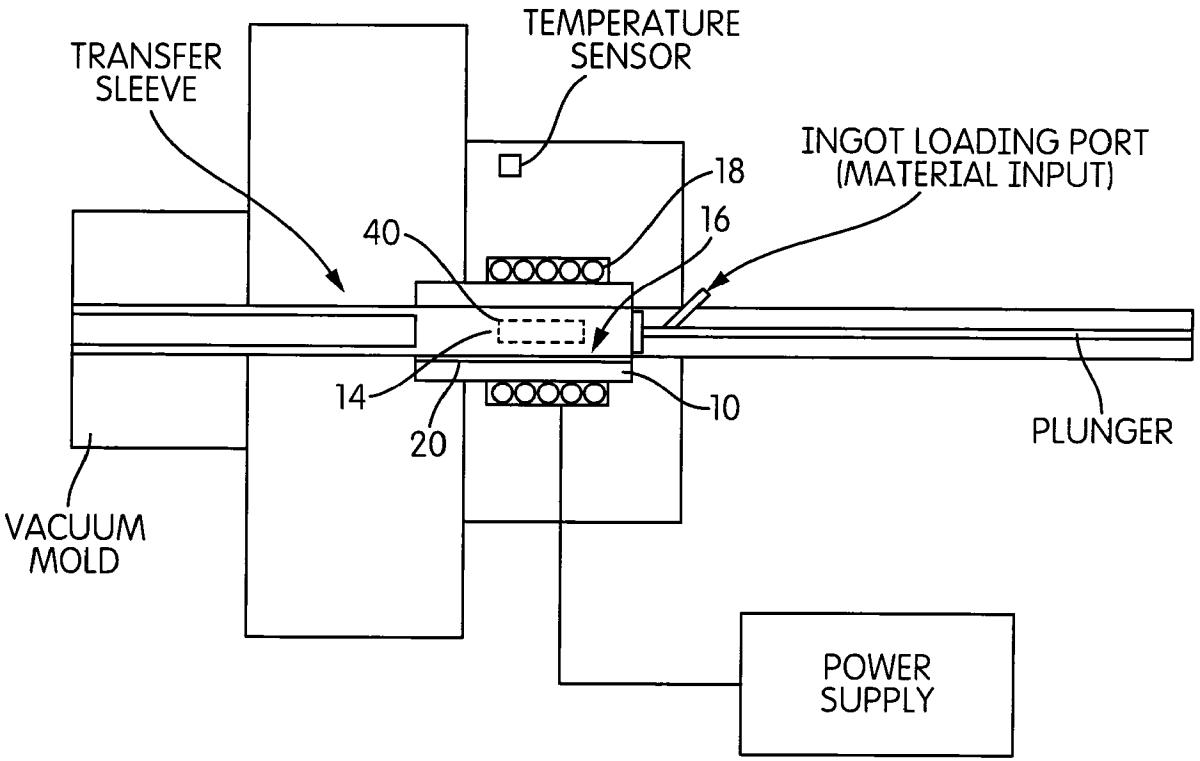
FIG. 9 illustrates a schematic diagram of an exemplary system for using a vessel such as disclosed herein.

As shown, the body 12 and coil 18 surrounding vessel 10 are configured to be positioned in a horizontal direction. For example, vessel 10 may be configured to be used in an injection molding system that is positioned to melt and move material in a horizontal (and longitudinal) direction. FIG. 9 schematically illustrates an example of such a system (and is further described below). Vessel 10 may receive material (e.g., in the form of an ingot) in its melting portion 14 using one or more devices of an injection system for delivery (e.g., loading port and plunger).

Vessel 10 also has one or more temperature regulating lines 20 within the body 12 configured to allow for a flow of a liquid (e.g., water, or other fluid) therein for assisting in regulating a temperature of the body during melting of meltable material received in the melting portion 14. The cooling line(s) 20 assist in preventing excessive heating and melting of the body 12 of the vessel 10 itself. The cooling line(s) 20 may include one or more inlets and outlets for the liquid or fluid to flow therethrough. As described below, the inlets and outlets of the cooling lines may be configured in any number of ways and are not meant to be limited. Cooling line(s) 20 are configured to be positioned within the body 12 relative to the melting portion 14. Cooling line(s) 20 may be positioned relative to melting portion 14 such that material on surface 16 is melted and the vessel temperature is regulated (i.e., heat is absorbed, and the vessel is cooled). For example, in the illustrative embodiment shown in FIGS. 1-5, for a boat or crucible type vessel that comprises a length and extends in a longitudinal direction, its melting portion 14 may also extend in a longitudinal direction. In accordance with an embodiment, cooling line(s) 20 may be positioned in a longitudinal direction relative to melting portion 14. For example, the cooling line(s) 20 may be positioned in a base of the body 12 (e.g., underneath surface 16). In another embodiment, the cooling line(s) 20 may be positioned in a horizontal or lateral direction.

Figure 11:
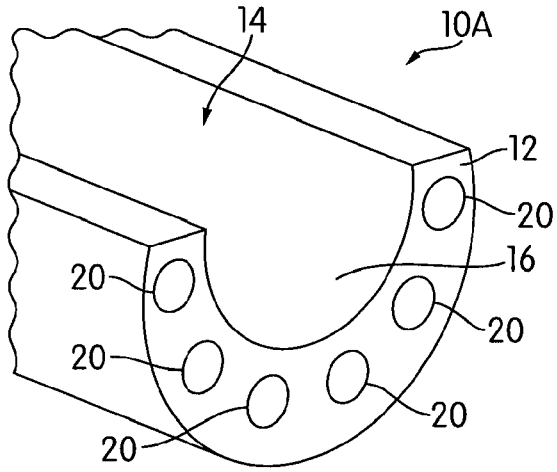
FIGS. 11 and 12 show a perspective end view and an end view of a vessel in accordance with another embodiment.
Figure 12:
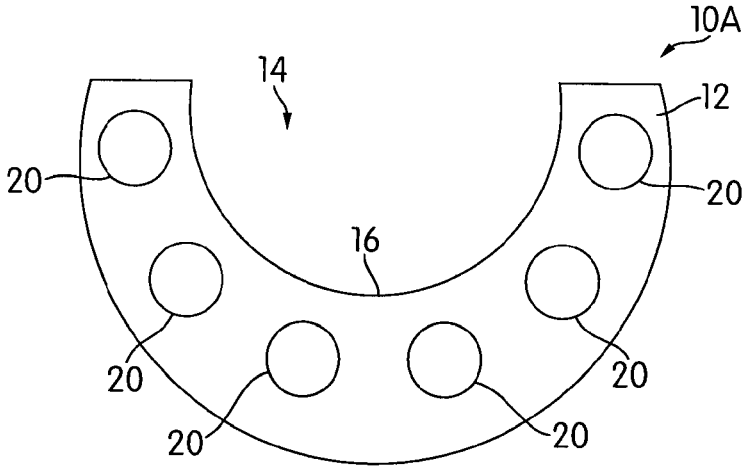

The number, positioning and/or direction of the cooling line(s) 20 should not be limited. Cooling line(s) 20 may be provided within the base and/or any of the walls of the body 12 in any number of positions or directions. For example, FIGS. 11 and 12 illustrate another embodiment of the disclosure wherein a plurality of cooling lines are positioned within a vessel 10*a*. Vessel 10*a* comprises similar elements as to vessel 10, and therefore similar reference numerals are used in the Figures. That is, vessel 10A of FIGS. 11 and 12 comprises a body 12 comprising a melting portion 14 with a surface 16 configured to receive meltable material to be melted therein and a plurality of temperature regulating lines 20 configured to flow a liquid therein for regulating a temperature of the body with the meltable material received in the melting portion 14 (during a heating/melting process). The body 12 of vessel 10A comprises a substantially U-shaped structure. The body 12 may comprise substantially rounded and/or smooth surfaces, with the surface 16 of the melting portion 14 formed in an arc shape, for example. Heating is accomplished using an induction coil 18 positioned adjacent the body 12 (not shown). For example, the coil 18 may be positioned in a helical manner around the body 12, such as shown in FIG. 1, or comprise other configurations that are configured to melt material within the body 12. The cooling lines 20 are positioned within the base and the walls of the vessel 10A. The cooling lines 20 are positioned in a longitudinal direction relative to melting portion 14 such that they extend between each end of the body 12. Each of the cooling lines 20 may be positioned in the vessel such each is substantially equally spaced from adjacent cooling lines within the body 12, for example.

Figure 13:
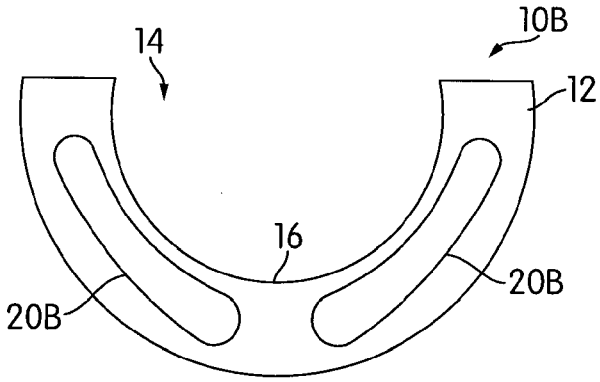
FIG. 13 illustrates an end view of a vessel in accordance with yet another embodiment.

FIG. 13 illustrates a non-limiting embodiment of an end of a vessel 10B in accordance with yet another embodiment, Vessel 10B comprises similar elements as to vessel 10, and therefore similar reference numerals are used in the Figures. That is, vessel 10B of FIG. 13. comprises a body 12 comprising a melting portion 14 with a surface 16 configured to receive meltable material to be melted therein and a plurality of temperature regulating lines 20B configured to flow a liquid therein for regulating a temperature of the body with the meltable material received in the melting portion 14 (during a heating/melting process). The body 12 of vessel 10B comprises a substantially U-shaped structure. The body 12 may comprise substantially rounded and/or smooth surfaces, with the surface 16 of the melting portion 14 formed in an arc shape, for example. Heating is accomplished using an induction coil 18 positioned adjacent the body 12 (not shown). For example, the coil 18 may be positioned in a helical manner around the body 12, such as shown in FIG. 1, or comprise other configurations that are configured to melt material within the body 12. The cooling lines 20B are positioned within the base and the walls of the vessel 10B. The cooling lines 20B are positioned in a longitudinal direction relative to melting portion 14 such that they extend between each end of the body 12. More specifically, the cooling lines 20B shown in FIG. 13 are in the form of slots, each extending between a base and a wall of the vessel. The slots may be machined to extend longitudinally and laterally within the body 12, for example.

The size (e.g., diameter or width) of the cooling lines is not limited. The size of the lines may be based on the number of cooling lines included in the body, for example. The size may also be based on the thickness and/or amount of desired cooling.

The inlets and outlets of the cooling lines of the vessel (e.g., such as vessel 10, 10A, or 10B) may be configured any number of ways. For example, in an embodiment, the cooling liquid may configured to enter and exit each cooling line(s) such that the liquid flows in one direction. In another embodiment, the liquid may be configured to flow in alternate directions, e.g., each adjacent line may include an alternating entrance and exit. In addition, the cooling lines may be configured to have one or more entrances/exits that are configured to allow flow of the liquid between the cooling lines. For example, in an embodiment wherein a vessel comprises longitudinally extending cooling lines, one or more of the cooling lines may include one or more lateral or extending line(s) that extend to another line(s) such that they are fluidly joined to each other. That is, the liquid is configured to not only run longitudinally along the body, but also through and between connected lines.

Other embodiments of vessels with cooling line(s) therein or associated therewith, besides those illustrated in the Figures, are also envisioned.

For simplicity and explanatory purposes only, the description below and the remaining Figures (e.g., FIGS. 10A-10Y) are shown and described with reference to vessel 10 of FIGS. 1-5. One should understand, however, that the description with regards to vessel 10 below also applies to vessels 10A and/or 10B, as well as other vessel configurations not necessarily illustrated in the Figures.

Vessel 10 has an inlet for inputting material (e.g., feedstock) into melting portion 14 of the body 12, and an outlet for outputting melted material from the melting portion 14. For example, vessel 10 may receive material (e.g., in the form of an ingot) in its melting portion 14 using one or more devices of an injection system for delivery (e.g., loading port and plunger, as shown in the injection system of FIG. 9).

When using a cold hearth melting device such as vessel 10, the amount of heat absorbed by the liquid configured to flow within the cooling line(s) 20 can be extremely high. For example, melt temperatures were tested and obtained while melting amorphous alloy using a vessel. The melt temperatures of amorphous alloy noted herein were obtained by the combination of measuring heat loss (to the vessel), stirring, and levitation of the magnetic field (e.g., caused by eddy currents from the induction heating). During such melting, it had been observed that an application of approximately 6 kW from the induction coil can bring approximately 60 grams of amorphous alloy from room temperature to about 940° C. within the base, while an application of approximately 12 kW can bring the same amorphous alloy to about 950° C., and an application of approximately 24 kW can bring the same amorphous alloy to about 955° C. Thus, although the power was quadrupled, the melt temperature rise of the amorphous alloy to about 940° C. simply asymptotically increased to about 955° C.

Accordingly, this disclosure describes embodiments of temperature regulated vessels designed to improve melt and process temperatures for systems, as well as improve power consumption. In accordance with an embodiment, a thermal insulator or barrier of a material 24 is applied to one or more surfaces of vessel 10 to implement such improvements, including reducing heat transfer, improving melt temperature of the material, and reducing power consumption (and waste of induction power and electricity). In an embodiment, the material 24 may be applied in the form of a layer. Throughout this disclosure, "layer" refers to a material that is provided over a surface. However, it should be understood that a layer need not be consistent, fully covering, or of a particular thickness or dimension. In fact, material 24 need not be applied in a layer. Accordingly, any reference to a "layer" of material throughout this disclosure should not be limiting. Also, as further detailed below, material 24 may be a material of low thermal conductivity (i.e., thermally insulating) configured to as an insulator or barrier with regards to the cooling line(s) 20. That is, material 24 is configured to reduce the amount of heat loss (transfer) from the melted material to the body 12 and to the cooling liquid in the line(s) 20.

Any number and/or types of methods may be used for applying material 24 to one or more parts of vessel 10 and should not be limiting. For example, the material 24 may be applied as a coating to one or more parts of a vessel 10 in some embodiments. Additionally or alternatively, techniques such as laminating, shielding, dipping, thermal, flame, or plasma spraying, plating, chemical vapor deposition, physical vapor deposition processes and/or other thermal or chemical processes may be used to add material 24 to one or more parts of the temperature regulated vessel embodiments disclosed herein. The process used for applying material to any of the herein described surfaces or areas of the vessel should also not be limited to including consistent and/or even coverage. For example, the material may be applied sporadically and/or in a pattern.

Figure 2:
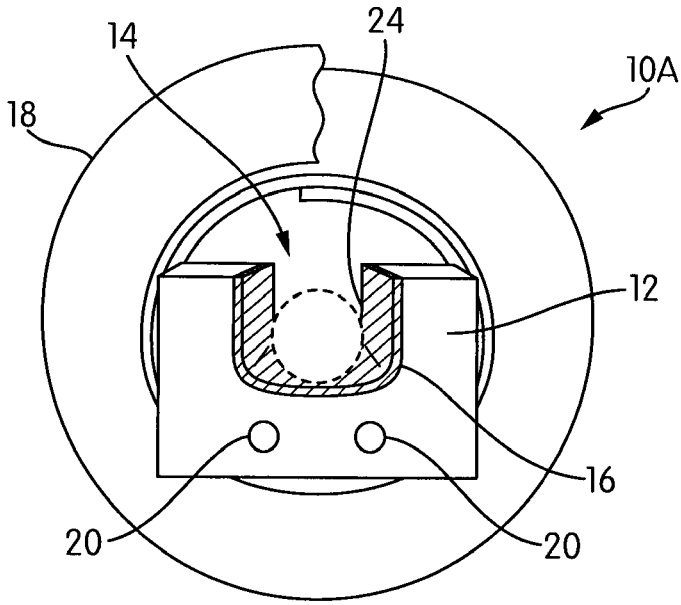
FIG. 2 illustrates an end view of a vessel in accordance with an embodiment.

In an embodiment, the material 24 may be provided on a lower or bottom surface area of the melting portion 14. In another embodiment, the material 24 is provided on a bottom surface as well as side surfaces of the melting portion 14. For example, FIG. 2 illustrates an end view of a vessel 10A in accordance with an embodiment having a substantial U-shaped structure and having material 24 on at least surface 16 of the melting portion 14. In an embodiment, the material is applied in the form of a layer on at least surface 16.

Figure 3:
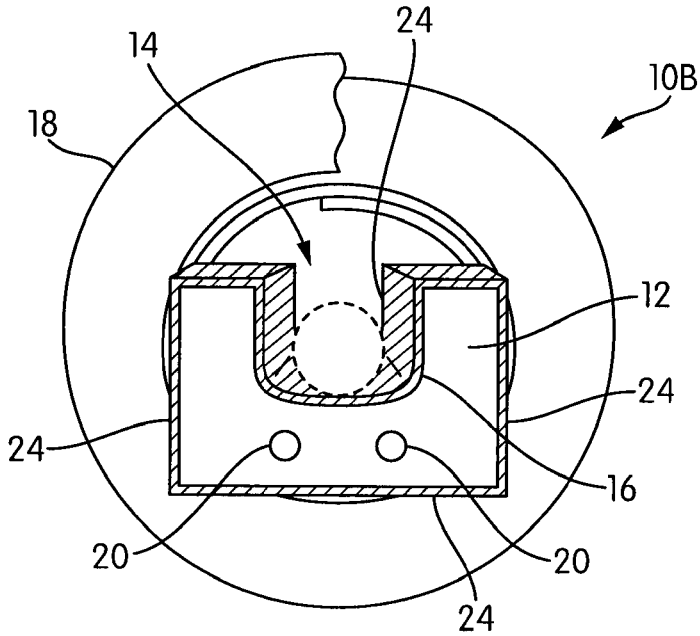
FIG. 3 illustrates an end view of a vessel in accordance with another embodiment.

In an embodiment, material 24 may be provided on external surfaces of body 12 of vessel 10. FIG. 3 illustrates another embodiment showing an end view of a vessel 10B having material 24 on each of the exterior or external surfaces of body 12 as well as the surface 16 of melting portion 14. However, in other embodiments, only some of the external surfaces of the body 12 may be provided with material 24.

Figure 4:
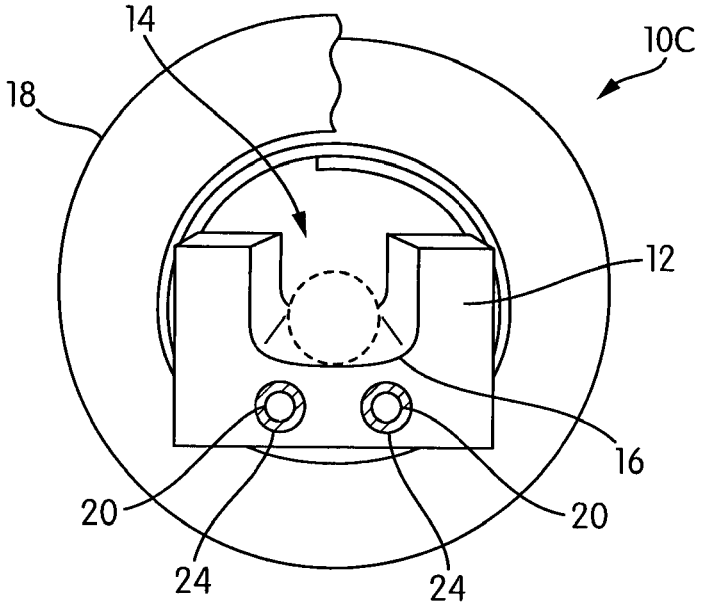
FIG. 4 illustrates an end view of a vessel in accordance with yet another embodiment.

FIG. 4 illustrates yet another embodiment showing an end view of a vessel 10C wherein one or more cooling line(s) 20 in the body 12 are provided with material 24 substantially therearound. The material may be applied to substantially surround the circumference and length of each of the line(s) 20, for example. In an embodiment, the material is applied in the form of a layer around line(s) 20.

In addition to the embodiments shown in FIGS. 2-4, material 24 may be applied and placed on any number of surfaces of the vessel 10, in any number of combinations. For example, as further described with respect to FIGS. 10A-10Y below, the material 24 may be applied to external surfaces of body 12 in conjunction with material 24 on the melting portion 14.

In accordance with an embodiment, each of the layer(s) or area(s) that material 24 is provided on parts of the body 12 of vessel 10 may be substantially the same material of low thermal conductivity. In another embodiment, each of the layer(s) or area(s) of material 24 may be different materials of low thermal conductivity. For example, in an embodiment, a first material 24 applied to vessel 10 in the melting portion 14 may be substantially similar to a second material 24 on external surfaces of the body 12. In an embodiment, either or both of the materials are applied in the form of a layer.

Also, the thickness of the material 24 as it is applied to one or more areas of the vessel 10 should not be limiting. In an embodiment, the thickness of material 24 can vary according to the location for placement of the material 24, for example.

In accordance with another embodiment, improvements such as those noted above (e.g., reduce an amount of heat transfer (and, therefore, cooling rate) to the liquid in cooling line(s) 20), may be implemented by providing at least surface 16 of melting portion 14 of vessel 10 such that its rate for transferring heat from the melting/melted material is reduced. Generally surfaces for receiving and melting material thereon may be substantially smooth. To improve heat transfer, in accordance with an embodiment, one or more surfaces of the vessel 10 are formed or machined to include a texture or pattern. In an embodiment, at least the surface 16 of the melting portion 14 is formed with a texture or pattern. The texturized or patterned surface(s) of the vessel 10 reduce contact between at least the meltable material and surface 16 of the melting portion 14, which in turn reduces heat loss and transfer to at least the cooling line(s) 20. The texture or pattern may be predefined or random or sporadic. The texture or pattern formed on surface(s) of the vessel may include indentations, which are defined as spaces in a surface of a structure configured to reduce surface contact therewith. They may include notches, recesses, depressions, pits, holes, dents, cross hatches, or divets, for example. The indentations may be formed in rows, for example. In an embodiment, the indentations on the surface(s) of the vessel may comprise trenches that extend along and within a surface. The trenches may be parallel to each other. In an embodiment, the trenches extend in a longitudinal direction of the vessel. Of course, other textures or patterns are also envisioned. For explanatory purposes only, indentations will be used to describe the texturized/patterned surface of the vessel 10.

Figure 5:
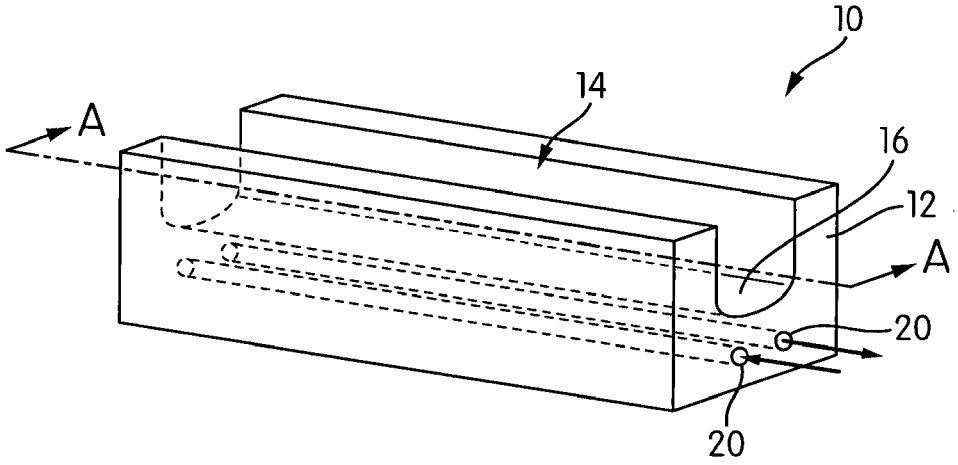
FIG. 5 illustrates a schematic plan view of the vessel of FIG. 1.
Figure 6:
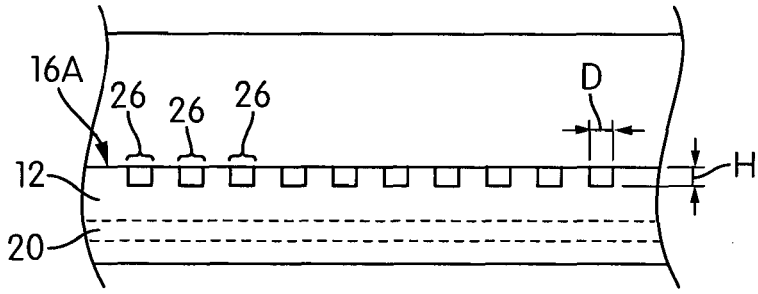
FIG. 6 illustrates a detailed view of a surface of the vessel taken along the section line 6-6 in FIG. 5, in accordance with an embodiment.

FIG. 6, for example, illustrates one embodiment of a detailed cross section taken along line 6-6 of FIG. 5, showing a surface 16A of a melting portion 14 of a body 12 of a vessel. A plurality of indentations 26 are provided in or on surface 16A. Each indentation 26 extends into the body 12 (e.g. towards an external surface). Applying indentations 26 (thereby forming a texture or a pattern) on surface 16A of a vessel minimizes contact of meltable material with the surface 16A of the vessel 10 (e.g., meltable material will be in contact with a top of the surface, but necessarily not bottoms of indentations).

The size and dimensions of indentations 26 are not meant to be limiting. In an embodiment, indentations 26 comprise a width D and a depth or height H. For example, width D may be the size of an opening in a lateral direction (e.g., perpendicular to a longitudinal direction of the vessel 10). In an embodiment, indentations may also comprise a length (e.g., relative to a longitudinal direction of the vessel 10). The dimensions of the indentations 26 may change according to their placement on the body 12. For example, a width or length of each indentation may be taken relative to a lateral wall or relative to an external surface.

In an embodiment, indentations 26 may comprise holes extending into the body. In an embodiment, indentations may be round or circular. For example, each indentations may comprise a diameter (e.g., that may be equivalent to a width D). In accordance with some embodiments, the dimensions of each of the indentations may vary. For example, a number of indentations may be formed at different heights and/or widths on the vessel. In another embodiment, a number of indentations of different depths may be provided on surface 16 of a melting portion of a vessel. In yet another embodiment, indentations 26 may comprise more than one depth or dimension. For example, indentations 26 may comprise a stepped configuration such that a portion of the indentations extends a distance further into the body (relative to the surface 16). As another example, rows (or trenches) of indentations may be provided at different depths along the surface of the vessel.

Additionally, the methods for forming such indentations are also not meant to be limiting.

In an embodiment, width or diameter D of indentations 26 is about 0.01 mm to about 1.5 mm. In another embodiment, width or diameter D of indentations 26 is about 0.01 mm to about 1.0 mm. In an embodiment, depth or height H of indentations 26 is about 0.01 mm to about 4.0 mm. In another embodiment, depth or height H of indentations 26 is about 0.1 mm to about 2.0 mm. Also, the indentations may be spaced a distance relative to each other (such as shown in FIG. 6) or have a common edge. In an embodiment, a distance between each of the indentations 26 may be predefined. For example, in an embodiment, the distance between each of the indentations 26 is about 0.01 mm to about 0.50 mm. Such dimensions are exemplary and are not limiting.

In an embodiment, indentations 26 can be coated or filled with a coating material. The coating material may be a layer of material of low thermal conductivity, such as material 24. Both the indentations 26 and the material 24 therein (or other coating) can assist in reducing heat transfer from the melting/melted material to the cooling line(s) 20. The material may be provided in one or more indentations in body 12. In an embodiment, at least some of the indentations are filled (at least partially). For example, as shown in the detailed view of FIG. 7, which shows a cross section taken along line 6-6 of FIG. 5 in accordance with another embodiment, a surface 16B has material 24 provided in its indentations 26. In an embodiment, the material 24 in FIG. 7 may be provided in some but not all of the indentations 26. For example, if indentations 26 are provided in a pattern of longitudinal rows along part of surface 16, every other row of indentations 26 may be filled (at least partially) with material. Alternatively, each row may be filled (at least partially) with material. Such an embodiment is exemplary and not limiting.

In addition to providing insulation to the body 12 of the vessel 10, the insertion of material 24 can also protect the body 12 from wear and tear. For example, in an embodiment, indentations in the form of trenches may be filled with a material 24, such as a hard insulated or a solid ceramic material. The trenches may be partially filled or substantially filled with material 24. The material in the trenches can assist and act as a guide for a plunger tip in an injection molding machine as the plunger tip pushes molten material forward.

FIG. 8 illustrates a detailed view of a plurality of indentations 30-36 in a surface of a vessel with material 24 in accordance with multiple embodiments. Each indentation 30, 32, 34, and 36 illustrates an exemplary embodiment of one or more indentations that may be provided on vessel 10, either alone or in combination with other indentations (with or without material therein).

Figure 7:
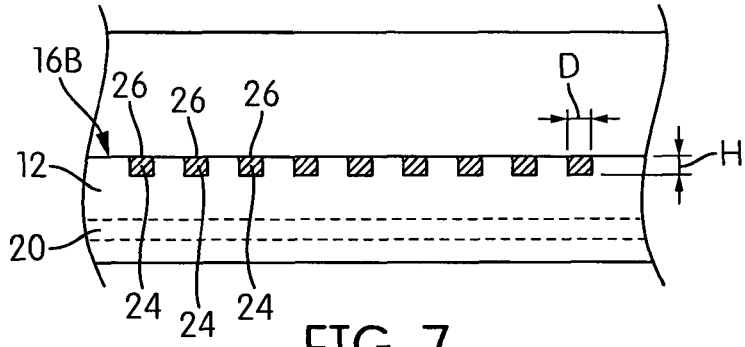
FIG. 7 illustrates a detailed view of a surface of the vessel taken along the section line 6-6 in FIG. 5, in accordance with another embodiment.

In one embodiment, one or more indentations 26 are substantially filled with material 24. For example, the embodiment of FIG. 7 shows material 24 may be provided in the indentations at a depth or height H. In another embodiment, such as shown by indentations 30 and 32 in FIG. 8, one or more indentations are at least partially filled with material 24. For example, material may be provided in indentations 26 at a depth or height h, wherein h is less than height H. Accordingly, a top of surface 16B and a top of material 24 in an indentation 26 may have a height difference A. In one embodiment, the height difference A remains. This can allow received material to be melted to be in contact with a top of the surface 16, but not top surface(s) of the material in indentations 26. In another embodiment, the height difference A is substantially filled with a material 38. Material 38 may be a material of low thermal conductivity. Material 38 may be a material that is different from either or both materials used to for body 12 and/or material 24. In one embodiment, the received material to be melted may contact top surfaces of material 38 in indentations, in addition to surface 16. In another embodiment, the coating or filling of the indentations 26 may be limited such that received material to be melted does not substantially contact material 38 in the indentations. For example, the material 38 may be provided on top of material 24, while still providing a space (i.e., a space that is less than height difference A) between top of material 38 and surface 16 of melting portion 14.

In another embodiment, as shown by filled indentation 34, the material 24 may be filled to a height H2 that exceeds a depth or height H of the indentation 26.

In yet another embodiment, as shown by filled indentation 36, one or more indentations and the surface 16 of the melting portion may be filled/covered. That is, the indentations may be filled with material and material 24 may also be provided over the filled indentations and at a thickness over the surface 16.

Although a plurality of indentations are generally shown and described with respect to FIGS. 6 and 7, it should be understood that it is within the scope of this disclosure that the number, shape, pattern, texture, dimensions (e.g., diameter, depth) associated with the indentations are not meant to be limiting. For example, in an embodiment, indentations 26 are provided in a predetermined pattern on surface 16 of melting portion 14. In another embodiment, indentations 26 may be strategically placed on the surface 16 based on a ratio between a total surface area of the indentations (not including the depth of the indentations) and a surface area of a melting surface (i.e., the surface area of the surface 16 minus the total surface area of the indentations). In an embodiment, the plurality of indentations 26 are provided on about 10% to about 90% of a surface area of the surface 16 of a vessel.

In an embodiment, the body 12 of the vessel 10 may be formed from a first material, the material 24 may be a second material, and material 38 may be a third material provided to cover the second material 24 (e.g., within the indentations) and/or body 12 (e.g., see filled indentation 36). The first, second, and third materials may each be different or similar. The second and third materials may each be materials of low thermal conductivity. In another embodiment, a fourth material may be provided (e.g., in a layer) on one or more of the surfaces such as described above with respect to FIGS. 2-4, i.e., material may be provided on the melting portion, on external surfaces of the body, and/or surrounding the cooling line(s) 20 of the vessel 10. The fourth material may include a material of low thermal conductivity.

Accordingly, it is envisioned that one or more or a combination of the above-described implementations of FIGS. 2-4 and FIGS. 6-7 may be provided in a temperature regulated vessel. FIGS. 10A, 10B, 10C, 10D, 10E, 10F, 10G, 10H, 10J, 10K, 10L, 10M, 10N, 10P, 10Q, 10R, 10S, 10T, 10V, 10X, 10W, and 10Y illustrate a plurality of schematic end views of vessels with surfaces of its body having material 24 of low thermal conductivity thereon. Although in each of these Figures the added material is noted as material 24, it should be understood based on the disclosure above that a combination of different materials (e.g., of low thermal conductivity) may be used on the noted parts and surfaces of the vessel 10. Accordingly, the schematic diagrams of the vessels in FIGS. 10A-10Y are for illustrative purposes only and are not meant to be limiting with regards to shape, material, or design.

Figure 10A:
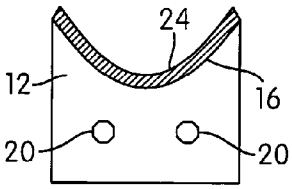
FIGS. 10A, 10B, 10C, 10D, 10E, 10F, 10G, 10H, 10J, 10K, 10L, 10M, 10N, 10P, 10Q, 10R, 10S, 10T, 10V, 10X, 10W, and 10Y illustrate schematic end views of vessels in accordance with embodiments.
Figure 10B:
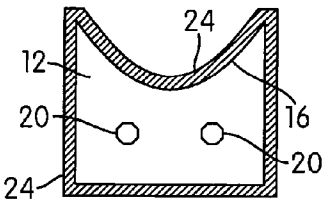
Figure 10C:
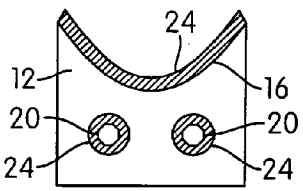
Figure 10D:
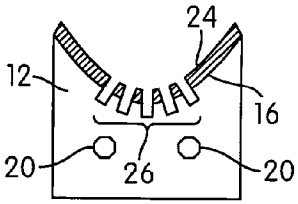
Figure 10E:
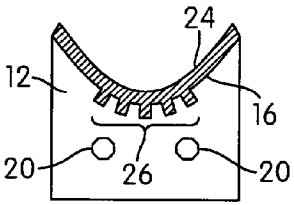

FIG. 10A illustrates material 24 on surface 16 of the melting portion 14 of the body 12 of a vessel, like FIG. 2. FIG. 10B illustrates material 24 on both the melting portion 14 and the external surfaces of the body 12 of a vessel, similarly to FIG. 3. FIG. 10C illustrates the surface 16 of the melting portion 14 of a vessel and the one or more cooling lines 20 each comprising material 24 thereon. FIG. 10D illustrates surface 16 of melting portion 14 of a vessel comprising a plurality of indentations 26 therein as well as material 24 on its surface. As illustrated by this embodiment, the material 24 need not be provided within the indentations 26, even though the surface 16 is coated. In FIG. 10E, however, a vessel comprises a plurality of indentations 26 with material 24 therein as well as on surface 16 of melting portion 14.

Figure 10F:
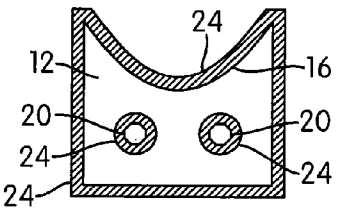
Figure 10G:
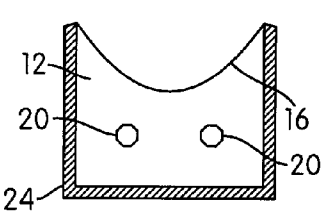
Figure 10H:
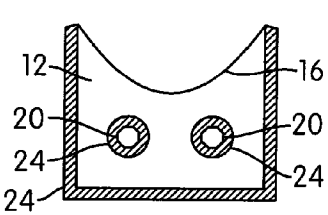

FIG. 10F illustrates a vessel with its external surfaces, surface 16 of melting portion, and cooling line(s) 20 comprising material 24 thereon. FIG. 10G illustrates a vessel with its external surfaces coated with material 24. FIG. 10H illustrates a vessel with both its external surfaces and cooling line(s) 20 substantially surrounded material 24.

Figure 10J:
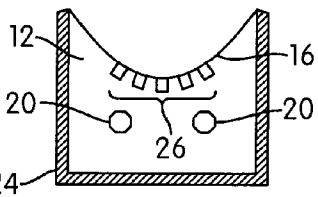
Figure 10K:
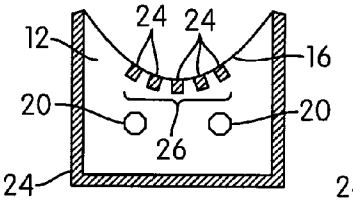
Figure 10L:
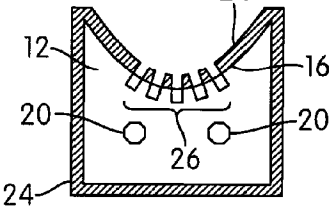
Figure 10M:
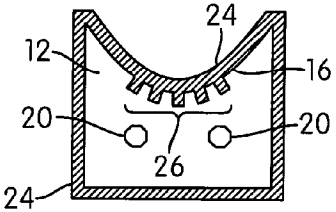

FIG. 10J illustrates a vessel with its external surfaces coated with material 24 and with surface 16 of melting portion having a plurality of indentations therein. In FIG. 10K, the vessel has its external surfaces coated with material 24 as well as surface 16 of melting portion having a plurality of indentations 26 that include material 24. FIG. 10L illustrates surface 16 of melting portion 14 comprising a plurality of indentations 26 therein as well as material 24 on its surface. As illustrated by this embodiment, the material 24 need not be provided within the indentations 26, even though the surface 16 is coated. The external surfaces of the vessel in FIG. 10L also comprise material 24 applied thereto. FIG. 10M, however, is similar to FIG. 10L, except that the vessel of FIG. 10M comprises a plurality of indentations 26 with material 24 therein as well as on surface 16 of melting portion 14 and external surfaces.

Figure 10N:
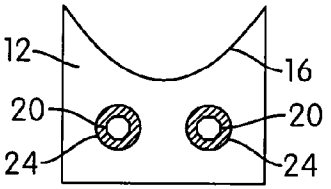
Figure 10P:
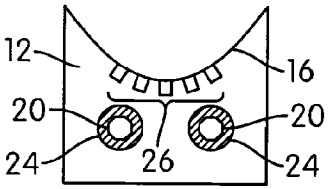
Figure 10Q:
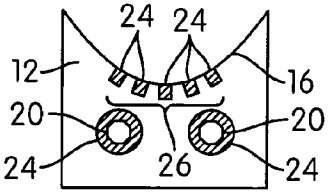
Figure 10R:
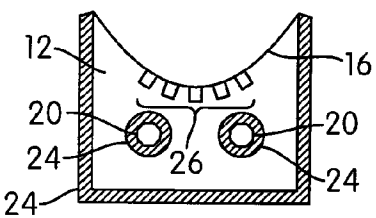
Figure 10S:
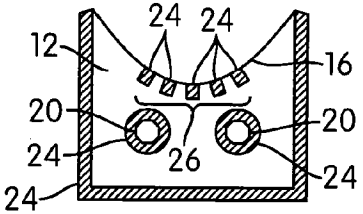

FIG. 10N is similar to FIG. 4 in that the vessel comprises material 24 surrounding cooling line(s) 20. FIG. 10P illustrates a vessel with material 24 surrounding its cooling line(s) 20 and with its melting portion comprising a plurality of indentations 26 (at least in surface 16). In FIG. 10Q, the vessel comprises material 24 surrounding its cooling line(s) 20, a melting portion comprising a plurality of indentations 26 (at least in surface 16), and material 24 with its indentations 26. FIG. 10R shows a vessel with material 24 on both of its external surfaces and surrounding its cooling line(s) 20, as well as a plurality of indentations 26 in its surface 16 of melting portion 14. The vessel of FIG. 10S has material 24 on both of its external surfaces and surrounding its cooling line (s) 20, a plurality of indentations 26 in its surface 16 of melting portion 14, and material 24 within the indentations 26.

Figure 10T:
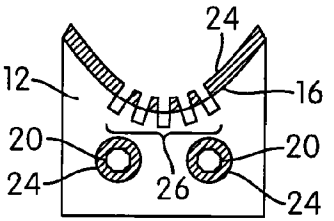
Figure 10V:
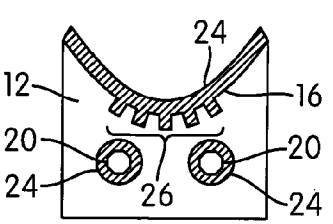

FIG. 10T illustrates application of material 24 surrounding cooling line(s) 20 and on surface 16 of melting portion 14 of a vessel. In this embodiment, the material 24 need not be provided within the indentations 26, even though the surface 16 is coated. In FIG. 10V, however, a vessel comprises a plurality of indentations 26 with material 24 therein as well as on surface 16 of melting portion 14. The vessel of FIG. 10V also has material 24 surrounding its cooling line(s) 20.

Figure 10W:
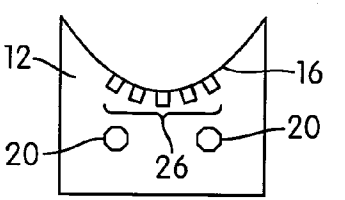
Figure 10X:
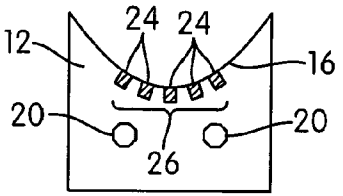
Figure 10Y:
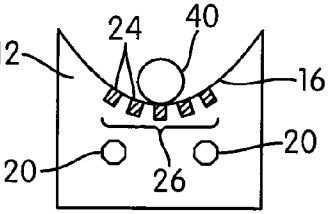

FIG. 10W illustrates a vessel comprising a plurality of indentations 26 in at least surface 16 of its melting portion 14. FIG. 10X illustrates a vessel comprising a plurality of indentations 26 in at least surface 16 of its melting portion 14 with material 24 in its indentations 26.

FIG. 10Y illustrates an example of a received material 40 to be melted being positioned on the vessel of FIG. 10X (with indentations 26 and material 24 in such indentations in its surface 16 of the melting portion 14). The received material 40 may be material configured for melting and that is used to form products or parts once melted and molded, for example. The received material 40 may be in the form of an ingot or a mass of material cast in a form for shaping, remelting, or refining.

The material(s) used to form body 12, the material(s) to be melted, and layer(s) of material 24 are not meant to be limiting. For example, in an embodiment, body 12 of vessel 10 may be formed from a first material, while a second material (to be melted) may be input or received by melting portion 14 of the body 12. The received second material (e.g., ingot 40) is different than the first material of the body 12. In an embodiment, a third material that is different than the first material of the body 12 and the received second material (for melting) is utilized as material 24. The layer of third material may be provided (or applied) substantially on surface 16, exterior surfaces of body 12 (with or without being applied to surface 16), surrounding cooling tube(s) 20, and/or in indentations 26. In an embodiment, the third material is applied in the form of a layer.

Body 12 may comprise one or more materials, including a combination of materials. For example, body 12 may comprise a metal or a combination of metals, such as one selected from the group of: stainless steel (SS), copper, copper beryllium, amcolloy, sialon ceramic, yttria, zirconia, chrome, titanium, and stabilized ceramic coating.

In one embodiment, the material to be melted (e.g., a received second material) is an amorphous alloy, which are metals that may behave like plastic, or alloys with liquid atomic structures. More specifically, an "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, is too fast for crystals to form and the material is "locked in" a glassy state. Also, amorphous metals can be produced with critical cooling rates low enough to allow formation of amorphous structure in thick layers (over 1 millimeter); these are known as bulk metallic glasses (BMG).

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials, may lead to better resistance to wear and corrosion. Amorphous metals, while technically glasses, may also be much tougher and less brittle than oxide glasses and ceramics.

Thermal conductivity of amorphous materials may be lower than that of the crystalline counterparts. To achieve formation of an amorphous structure even during slower cooling, the alloy may be made of three or more components, leading to complex crystal units with higher potential energy and lower chance of formation. The formation of amorphous alloy can depend on several factors: the composition of the components of the alloy; the atomic radius of the components (preferably with a significant difference of over 12% to achieve high packing density and low free volume); and the negative heat of mixing of the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used.

Another useful property of bulk amorphous alloys is that they can be true glasses; in other words, they can soften and flow upon heating. This allows for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

An amorphous metal or amorphous alloy can refer to a metal-element-containing material exhibiting only a short range order—the term "element" throughout this application refers to the element found in a Periodic Table. Because of the short-range order, an amorphous material can sometimes be described as "glassy." Thus, as explained above, an amorphous metal or alloy can sometimes be referred to as "metallic glass" or "Bulk Metallic Glass" (BMG).

The terms "bulk metallic glass" ("BMG"), bulk amorphous alloys, and bulk solidifying amorphous alloys are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shape or form described above, as related to a metallic glass. Accordingly, a BMG described herein in some embodiments can be different from a thin film made by a conventional deposition technique in one important aspect—the former can be of a much larger dimension than the latter.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous. A partially amorphous composition can refer to a composition at least about 5 vol % of which is of an amorphous phase, such as at least about 10 vol %, such as at least 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or different chemical composition. In one embodiment, they have substantially the same chemical composition. In another embodiment, the crystalline phase can be more ductile than the BMG phase.

The methods described herein can be applicable to any type of amorphous alloys. Similarly, the amorphous alloys described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, or combinations thereof. Namely, the alloy can include any combination of these elements in its chemical formula or chemical composition. The elements can be present at different weight or volume percentages. For example, an iron "based" alloy can refer to an alloy having a non-significant weight percentage of iron present therein, the weight percent can be, for example, at least about 10 wt %, such as at least about 20 wt %, such as at least about 40 wt %, such as at least about 50 wt %, such as at least about 60 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. In some embodiments, the alloy, or the composition including the alloy, can be substantially free of nickel, aluminum, or beryllium, or combinations thereof. In one embodiment, the alloy or the composite is completely free of nickel, aluminum, or beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1.

TABLE 1

Exemplary amorphous alloy compositions

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | Sn | |
| | 50.75% | 36.23% | 4.03% | 9.00% | 0.50% | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Au | Ag | Pd | Cu | Si | |
| | 49.00% | 5.50% | 2.30% | 26.90% | 16.30% | |
| 13 | Au | Ag | Pd | Cu | Si | |
| | 50.90% | 3.00% | 2.30% | 27.80% | 16.00% | |
| 14 | Pt | Cu | Ni | P | | |
| | 57.50% | 14.70% | 5.30% | 22.50% | | |
| 15 | Zr | Ti | Nb | Cu | Be | |
| | 36.60% | 31.40% | 7.00% | 5.90% | 19.10% | |
| 16 | Zr | Ti | Nb | Cu | Be | |
| | 38.30% | 32.90% | 7.30% | 6.20% | 15.30% | |
| 17 | Zr | Ti | Nb | Cu | Be | |
| | 39.60% | 33.90% | 7.60% | 6.40% | 12.50% | |
| 18 | Cu | Ti | Zr | Ni | | |
| | 47.00% | 34.00% | 11.00% | 8.00% | | |
| 19 | Zr | Co | Al | | | |
| | 55.00% | 25.00% | 20.00% | | | |

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2PllC6B4. Another example is Fe72Al7Zrl0Mo5W2B15. Another iron-based alloy system that can be used in the coating herein is disclosed in US 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the composition consists essentially of the amorphous alloy (with only a small incidental amount of impurities). In another embodiment, the composition consists of the amorphous alloy (with no observable trace of impurities).

Material 24 may be formed from one or more materials, or a combination of materials. In embodiments, material 24 is a poor thermal conductor material, i.e., a material with low thermal conductivity. For example, in an embodiment, the material 24 may be a material that is capable of transferring heat at a rate of less than one-third of that of the material used to form the body 12. In an embodiment, material 24 is a magnetic material.

In an embodiment, material 24 may comprise at least one of the following group: ceramic, quartz, stainless steel, titanium, chrome, copper, silver, gold, diamond-like carbon, yttria, yttria oxide, and zirconia. Ceramic, for example, is a non conductive to RF power (i.e., from induction coil 18), because RF power does not heat or change the temperature of ceramic materials. Using poor thermal conducting materials such as these as the material 24 on/with vessel 10 will actively regulate the temperature of molten material and the vessel. In an embodiment, the ceramic may comprise an oxide, a nitride, an oxynitride, a carbide, or combinations thereof. In another embodiment, ceramic comprises yttria, silicon nitride, silicon oxynitride, silicon carbide, or combinations thereof. In yet another embodiment, material 24 may be yttrium oxide.

Moreover, in accordance with an embodiment, if material 24 (such as ceramic) that has thermal insulating properties is provided over surface(s) of the body 12, the materials used to form the body 12 are not restricted. That is, a body 12 of a vessel 10 may be formed of a material that may be RF sensitive, e.g., if the body 12 is covered in a thermally insulating material such as material 24, the sensitivity of the body 12 may be substantially reduced. Also, harder but more wear resistant alloys (e.g., beryllium copper) with lower conductivity may also be used and coated with material 24, with an increase in power consumption.

In an embodiment, body 12 is formed from one or more materials that are RF insensitive. In an exemplary embodiment, vessel 10 comprises a body 12 formed from stainless steel that is coated with a shielding of copper (material 24). Stainless steel impedes heat flow from the molten material, but also absorbs a lot of RF power from the induction heater/coil. The copper coating has rapid heat absorption from the heat flow from the molten material, but does not generally absorb RF power.

In another embodiment, the vessel comprise stainless steel and a layer 24 of silver. In another embodiment, the vessel comprises titanium and a layer 24 of copper. In yet another embodiment, the vessel comprises titanium and a layer 24 of silver.

The following are two experimental examples that were tested of vessels having a layer such as material 24 and that was used to melt an amorphous alloy (i.e., Vitreloy 1):

Example 1

A vessel was coated with yttrium oxide and was observed to bring the melt temperature of a 60 g of Vitreloy-1 ingot (placed within the melting portion) to 1100° C. instead of 940° C. The yttrium oxide reduced the heat loss between the Vitreloy-1 and the crucible (thereby increasing the melt temperature and product temperature).

Example 2

A vessel was lined with a 3 mm Sialon ceramic, a thermal insulator, and RF transparent material. The vessel was observed to bring the melt temperature of a 60 g of Vitreloy-001 to around 1100° C. as well.

The above described embodiments of vessels may be used in any number of manufacturing methods or processes for melting material, such as amorphous alloy. By obtaining a vessel 10 (as shown in any of the Figures), the method for melting can be implemented by inserting material into a loading port (e.g., in the form of an ingot) and such that it is received in a melting portion of the body 12 (e.g., via an insertion port). After material is received by body 12, the surfaces of the vessel 10 and thus the material can be heated via activating a heat source (induction coil 18) positioned adjacent the vessel 10. While heating, cooling liquid flows through cooling lines 20 of the vessel 10 to assist in regulating its temperature (i.e., heat is absorbed, vessel is cooled) such that it is maintained at a substantially consistent temperature. Vacuum pressure may be applied during the method of melting. After material is melted and force cooled using vessel 10, it can be moved into a mold of the system, for example.

Also, the application or apparatus that utilizes vessel 10 and the herein described thermal barriers should also not be limiting. FIG. 9 illustrates an exemplary injection molding system using vessels such as the vessels illustrated in FIGS. 2-4 and FIGS. 6-7. The system is configured to melt material in a vessel positioned in a substantially horizontal direction. The vessel can be configured to be positioned such that its length extends in a horizontal direction with the system. More specifically, such a system utilizes a boat style melting system, in which a water-cooled, spoon-shaped cavity (e.g., U-shaped melting portion) formed in a conductive metal base or body (such as copper) is placed within an induction coil in order to melt a material (e.g., metal or alloy) placed inside the cavity of the vessel. The system may perform insertion of the material and melting under vacuum pressure.

After implementing a method of melting material using a vessel such as disclosed herein, the injection molding system such as shown in FIG. 9 may be configured to inject material into a mold in a substantially horizontal direction by moving a plunger in a longitudinal and/or horizontal direction, for example. The plunger may be configured to push a material for melting into the body 12, and/or move the melted material from the melting portion 14 in a substantially horizontal direction through a transfer sleeve (also called a cold sleeve) and into a vacuum mold for molding. Such a system, however, is not meant to be limiting. A horizontal system setup such as shown schematically in FIG. 9 may desire substantial amounts of additional power to increase the melt temperature of the material being melted beyond a certain limit imposed by the equipment configuration. However, a thermal barrier (such as described above) allows higher overheats to be induced at relatively low applied power, simply by increasing the temperature differential between the water-cooled substrate and the bottom of the heated alloy resting on the substrate.

The herein disclosed thermal barrier techniques may also be applied to skull melt crucibles. For example, in an embodiment, each individual pillar has material 24 (and/or texture or indentations 26) on its inside face(s), i.e., the side(s) which will be on the interior of the vessel or crucible. In addition or in the alternative, the base and/or walls can comprise material 24 thereon and/or indentations 26 therein. In this way, power requirements for skull melting can be reduced, and/or the temperature of the melt increased.

In the case of skull melting, a crucible comprising individual water-cooled vertical pillars and a fixed or movable bottom, also water-cooled, is placed inside an inductive coil in order to heat a metal charge inside. The gaps between the pillars allow inductive power to be transferred inside the conductive crucible in order to melt the alloy charge through eddy current heating.

This technique can also be used to minimize the skull which forms between the molten alloy and copper hearth in plasma arc melting. This will allow the metal to be rendered more homogenous. One such application is thus for suction or tilt casting from a plasma arc melter, in which both the molten alloy and the skull are sucked or poured into a cold mold. By reducing the skull, particularly for short duration heating cycles, more uniform casts can be produced.

Accordingly, the herein described implementations of using a thermal insulator on a vessel (in the form of material 24, or indentations 26, or both) improves overall performance of the device, including but not limited to efficiency, versatility, and potential longer life of the vessel. Employing such implementations increases control of the force cooling of the vessel so that the cooling time of the vessel—and thus, material—is reduced, and the received material (e.g., feedstock input through inlet) is properly molten. This allows an increase in power from the induction coil (because less RF power is absorbed/wasted) and a decrease in loss of heat from the molten material to the liquid within the cooling line(s), while still controlling the temperature of the vessel and molten material. In other words, the thermal insulation allows the melt temperature to rise without using extra power. Accordingly, a higher energy efficiency may be achieved. Additionally, such thermal insulating applications and techniques improve system efficiency, provide potentially longer life of the vessel, and greater versatility.

For example, if vessels may made of harder, more wear resistant alloys (for example, beryllium copper) that generally have a lower conductivity use one or more of the thermal barrier methods disclosed herein, such materials can be employed without a substantial increase in power consumption.

The aforedescribed vessel or crucible can be used in a fabrication device and/or process including using BMG (or amorphous alloys). Because of the superior properties of BMG, BMG can be made into structural components in a variety of devices and parts. One such type of device is an electronic device.

An electronic device herein can refer to any electronic device known in the art. For example, it can be a telephone, such as a cell phone, and a land-line phone, or any communication device, such as a smart phone, including, for example an iPhone™, and an electronic email sending/melting device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Accordingly, the herein described embodiments of the vessel provide improved devices for melting materials such as amorphous alloys. Besides the melt temperature regulation provided by the liquid configured to flow to through its cooling line(s), the vessel also includes a material of low thermal conductivity on one or more of its surfaces and/or indentations (that may have material therein) to assist in unwanted heat loss/transfer, as previously noted. The herein disclosed vessel allows for use of more RF power from the induction coil to heat the meltable material feedstock with less loss of heat from the meltable material to the body/cooling lines, while still controlling the temperature of the vessel. In addition, such vessels such as those described herein provide a clean melt and delivery system with minimal contamination, and a reduction in the cost of manufacturing. The power consumption is substantially reduced because at least part of the vessel is thermally isolated to consume or absorb less applied RF power and the material being melted absorbs more (thus improving melt temperature of the material(s) for melting, and system efficiency).

Additionally, the material 24 on the body 12 can be maintained at a low temperature to prevent wetting, attack and dissolution, while the overall temperature of the material being melted is elevated.

It should again be noted that any reference to material 24 (i.e., a material of low thermal conductivity or a poor thermal insulator) on any of the surfaces of vessel 10 with respect to the drawings is not meant to refer to substantially same material being applied to each of the surfaces. The material(s) applied to any of the surfaces may be the same or different. For example, as described with respect to FIGS. 10A-10Y, one or more surfaces may comprise material 24 thereon. However, as an example, the material 24 of low thermal conductivity applied to a first surface (e.g., surface 14/16) in FIG. 10C need not be the same material 24 of low thermal conductivity on the second surface (e.g., cooling line 20). Any reference to a first, second, third, and/or fourth material(s) should be understood that the material 24 is a material of low thermal conductivity, and that any of the materials can be the same or different from each other.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that various of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. A temperature regulated vessel, comprising:

a body with walls comprising a melting portion configured to receive meltable material to be melted therein, the melting portion comprising a surface including one or more indentations therein;

one or more temperature regulating lines within the walls of the body and configured to flow a liquid therein for regulating a temperature of the body during melting of the meltable material received in the melting portion, and a first material of low thermal conductivity provided on at least the melting portion.

2. The vessel according to claim 1, further comprising a second material of low thermal conductivity provided on external surfaces of the body.

3. The vessel according to claim 1, wherein the first material is at least one selected from the group consisting of: ceramic, quartz, stainless steel, titanium, chrome, copper, silver, gold, diamond-like carbon, yttria oxide, and zirconia.

4. The vessel according to claim 2, further comprising a third material of low thermal conductivity substantially surrounding the one or more temperature regulating lines.

5. The vessel according to claim 1, further comprising a second material of low thermal conductivity substantially surrounding the one or more temperature regulating lines.

6. The vessel according to claim 1, wherein the body is formed from a stainless steel, copper, or titanium material.

7. The vessel according to claim 1, wherein the plurality of indentations comprise a second material of low thermal conductivity therein.

8. The vessel according to claim 2, wherein the first material and the second material are different.

9. The vessel according to claim 4, wherein the first material and the third material are the same.

10. The vessel according to claim 7, wherein the first material and the second material are the same.

11. The vessel according to claim 1, wherein the body has a substantially U-shaped structure.

12. The vessel according to claim 1, further comprising an induction coil positioned adjacent the body configured to melt the meltable material received in the melting portion.

13. A temperature regulated vessel, comprising:

a body with walls comprising a melting portion configured to receive meltable material to be melted therein, the melting portion comprising a surface including one or more indentations therein;

one or more temperature regulating lines within the walls of the body and configured to flow a liquid therein for regulating a temperature of the body during melting of the meltable material received in the melting portion, and a first material of low thermal conductivity provided on at least external surfaces of the body.

14. The vessel according to claim 13, further comprising a second material of low thermal conductivity substantially surrounding the one or more temperature regulating lines.

15. The vessel according to claim 13, wherein the plurality of indentations comprise a second material of low thermal conductivity therein.

16. The vessel according to claim 13, further comprising a second material of low thermal conductivity provided on the melting portion.

17. The vessel according to claim 15, further comprising a third material of low thermal conductivity provided on the melting portion.

18. The vessel according to claim 14, wherein the first material and the second material are different.

19. The vessel according to claim 15, wherein the first material and the second material are the same.

20. The vessel according to claim 16, wherein the first material and the second material are the same.

21. The vessel according to claim 17, wherein the third material and the second material are the same.

22. The vessel according to claim 13, wherein the body has a substantially U-shaped structure.

23. The vessel according to claim 13, further comprising an induction coil positioned adjacent the body configured to melt the meltable material received in the melting portion.

24. The vessel according to claim 13, wherein the first material is at least one selected from the group consisting of: ceramic, quartz, stainless steel, titanium, chrome, copper, silver, gold, diamond-like carbon, yttria oxide, and zirconia.

25. The vessel according to claim 13, wherein the body is formed from a stainless steel, copper, or titanium material.

26. A temperature regulated vessel, comprising:

a body with walls comprising a melting portion configured to receive meltable material to be melted therein, the melting portion comprising a surface including one or more indentations therein;

one or more temperature regulating lines within the walls of the body and configured to flow a liquid therein for regulating a temperature of the body during melting of the meltable material received in the melting portion, and a first material of low thermal conductivity surrounding the one or more temperature regulating lines.

27. The vessel according to claim 26, wherein the plurality of indentations comprise a second material of low thermal conductivity therein.

28. The vessel according to claim 26, further comprising a second material of low thermal conductivity provided on external surfaces of the body.

29. The vessel according to claim 27, further comprising a third material of low thermal conductivity provided on external surfaces of the body.

30. The vessel according to claim 26, further comprising a second material of low thermal conductivity provided on the melting portion.

31. The vessel according to claim 27, further comprising a third material of low thermal conductivity provided on the melting portion.

32. The vessel according to claim 27, wherein the first material and the second material are different.

33. The vessel according to claim 28, wherein the first material and the second material are the same.

34. The vessel according to claim 30, wherein the first material and the second material are the same.

35. The vessel according to claim 31, wherein the second material and the third material are the same.

36. The vessel according to claim 26, wherein the body has a substantially U-shaped structure.

37. The vessel according to claim 26, further comprising an induction coil positioned adjacent the body configured to melt the meltable material received in the melting portion.

38. The vessel according to claim 26, wherein the first material is at least one selected from the group consisting of: ceramic, quartz, stainless steel, titanium, chrome, copper, silver, gold, diamond-like carbon, yttria oxide, and zirconia.

39. The vessel according to claim 26, wherein the body is formed from a stainless steel, copper, or titanium material.

40. A temperature regulated vessel, comprising:

a body with walls comprising a melting portion configured to receive meltable material to be melted therein, the melting portion comprising a surface having a plurality of indentations therein, and one or more temperature regulating lines within the walls of the body and configured to flow a liquid therein for regulating a temperature of the body during melting of the meltable material received in the melting portion.

41. The vessel according to claim 40, wherein a first material of low thermal conductivity is provided within or on at least the plurality of indentations of the melting portion.

42. The vessel according to claim 40, wherein the melting portion has a substantially U-shaped structure.

43. The vessel according to claim 40, further comprising an induction coil positioned adjacent the body configured to melt the meltable material received in the melting portion.

44. The vessel according to claim 41, wherein the first material is at least one selected from the group consisting of: ceramic, quartz, stainless steel, titanium, chrome, copper, silver, gold, diamond-like carbon, yttria oxide, and zirconia.

45. The vessel according to claim 40, wherein the body is formed from a stainless steel, copper, or titanium material.

46. The vessel according to claim 44, wherein the body is formed from a stainless steel, copper, or titanium material.

47. The vessel according to claim 40, wherein the plurality of indentations comprises substantially round holes extending into the body.

48. The vessel according to claim 47, wherein each hole comprises a diameter, and wherein the diameter of each of the holes is about 0.01 mm to about 1.5 mm.

49. The vessel according to claim 47, wherein each hole comprises a depth, and wherein the depth of each of the holes from the surface of the melting portion and into the body is about 0.001 mm to about 4.0 mm.

50. The vessel according to claim 40, wherein the plurality of indentations are provided on about 10% to about 90% of a surface area of the surface.

51. The vessel according to claim 41, wherein each of the plurality of indentations are substantially filled with the first material.

52. The vessel according to claim 41, wherein each of the plurality of indentations are partially filled with the first material.

53. A temperature regulated vessel, comprising:

a body with walls comprising a melting portion configured to receive meltable material to be melted therein, the body comprising a first material and the meltable material comprising a second material;

one or more temperature regulating lines within the walls of the body and configured to flow a liquid therein for regulating a temperature of the body during melting of the meltable material received in the melting portion, the melting portion comprising a surface having a plurality of indentations therein, and wherein at least the plurality of indentations of the melting portion has a third material provided therein or thereon.

54. The vessel according to claim 53, wherein the first material of the body comprises stainless steel, copper, or titanium.

55. The vessel according to claim 53, wherein the third material comprises a thermally insulated material.

56. The vessel according to claim 53, wherein the third material in at least the plurality of indentations is at least one selected from the group consisting of: ceramic, quartz, stainless steel, titanium, chrome, copper, silver, gold, diamond-like carbon, yttria oxide, and zirconia.

57. The vessel according to claim 53, wherein the body has a substantially U-shaped structure.

58. The vessel according to claim 53, further comprising an induction coil positioned adjacent the body configured to melt the meltable material received in the melting portion.

59. The vessel according to claim 53, wherein the plurality of indentations comprises substantially round holes extending into the body.

60. The vessel according to claim 59, wherein each hole comprises a diameter, and wherein the diameter of each of the holes is about 0.01 mm to about 1.5 mm.

61. The vessel according to claim 59, wherein each hole comprises a depth, and wherein the depth of each of the holes from the surface of the melting portion and into the body is about 0.001 mm to about 4.0 mm.

62. The vessel according to claim 53, wherein the plurality of indentations are provided on about 10% to about 90% of a surface area of the surface.

63. The vessel according to claim 53, wherein each of the plurality of indentations are substantially filled with the first material.

64. The vessel according to claim 53, wherein each of the plurality of indentations are partially filled with the first material.

* * * * *